US009728854B2

(12) United States Patent
Kim et al.

(10) Patent No.: US 9,728,854 B2
(45) Date of Patent: Aug. 8, 2017

(54) ANTENNA USING EXTERIOR METAL FRAME AND ELECTRONIC DEVICE UTILIZING THE SAME

(71) Applicant: Samsung Electronics Co., Ltd., Gyeonggi-do (KR)

(72) Inventors: Jae-Hyung Kim, Seoul (KR); Jong-Suk Kim, Gyeonggi-do (KR); Tae-Gyu Kim, Gyeonggi-do (KR); Jin-Kyu Bang, Gyeonggi-do (KR); Dong-Jun Oh, Gyeonggi-do (KR); Kyung-Bae Ko, Gyeonggi-do (KR); Dong-Hwan Kim, Gyeonggi-do (KR); Ki-Young Chang, Seoul (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 14/843,393

(22) Filed: Sep. 2, 2015

(65) Prior Publication Data

US 2016/0064820 A1 Mar. 3, 2016

(30) Foreign Application Priority Data

Sep. 2, 2014 (KR) ..... 10-2014-0116104

(51) Int. Cl.
*H01Q 1/24* (2006.01)
*H01Q 5/50* (2015.01)
(Continued)

(52) U.S. Cl.
CPC ..... *H01Q 5/50* (2015.01); *H01Q 1/24* (2013.01); *H01Q 1/243* (2013.01); *H01Q 1/42* (2013.01); *H01Q 1/48* (2013.01); *H01Q 1/50* (2013.01); *H01Q 5/10* (2015.01); *H01Q 7/00* (2013.01); *H01Q 9/04* (2013.01); *H01Q 9/045* (2013.01);
(Continued)

(58) Field of Classification Search
CPC .. H01Q 1/24; H01Q 1/48; H01Q 5/10; H01Q 5/50; H01Q 9/045; H01Q 13/10
See application file for complete search history.

(56) References Cited

U.S. PATENT DOCUMENTS 7,612,725 B2 11/2009 Hill et al.
2010/0123632 A1 5/2010 Hill et al.
(Continued)

FOREIGN PATENT DOCUMENTS

EP 2 528 165 11/2012
EP 2 597 724 5/2013

OTHER PUBLICATIONS

European Search Report dated Dec. 18, 2015 issued in counterpart application No. 15183446.2-1811, 8 pages.

*Primary Examiner* — Hoang Nguyen
(74) *Attorney, Agent, or Firm* — The Farrell Law Firm, P.C.

(57) ABSTRACT

An antenna device that uses an exterior metal frame is provided. The antenna includes a Printed Circuit Board (PCB); a plurality of segment-type exterior metal frames spaced apart from the PCB; a feeding portion connected to one metal frame of the plurality of segment-type exterior metal frames; and a slit located between the PCB and the one metal frame, wherein the one metal frame fed through the feeding portion operates with radiation, or the slit operates with radiator, or another exterior metal frame fed through the feeding portion operates with radiation.

18 Claims, 20 Drawing Sheets

(51) Int. Cl.

| | |
|---|---|
| ***H01Q 9/04*** | (2006.01) |
| ***H01Q 13/10*** | (2006.01) |
| ***H01Q 7/00*** | (2006.01) |
| ***H01Q 1/48*** | (2006.01) |
| ***H01Q 1/50*** | (2006.01) |
| ***H01Q 5/10*** | (2015.01) |
| ***H01Q 1/42*** | (2006.01) |
| ***H01Q 9/42*** | (2006.01) |
| ***H01Q 21/28*** | (2006.01) |

(52) U.S. Cl.
CPC ..... *H01Q 9/0421* (2013.01); *H01Q 9/42* (2013.01); *H01Q 13/10* (2013.01); *H01Q 21/28* (2013.01)

(56) References Cited

U.S. PATENT DOCUMENTS

2013/0099983 A1 4/2013 Han et al.
2013/0135157 A1* 5/2013 Tsou ..... H01Q 1/2266
343/702

* cited by examiner

ANTENNA USING EXTERIOR METAL FRAME AND ELECTRONIC DEVICE UTILIZING THE SAME

PRIORITY

This application claims priority under 35 U.S.C. §119(a) to a Korean Patent Application filed in the Korean Intellectual Property Office on Sep. 2, 2014, and assigned Serial No. 10-2014-0116104, the entire contents of which are incorporated herein by reference.

BACKGROUND

1. Field of the Invention

The present invention relates to an antenna using an exterior metal frame and an electronic device utilizing the antenna.

2. Description of the Related Art

Electronic devices that have a communication function have recently become smaller in size and lighter in weight, and there is a demand for a capability to receive mobile communication services of different frequency bands using only one electronic device.

For example, an electronic device capable of simultaneously using multi-band signals is optionally required to provide mobile communication services using various frequency bands such as a Code Division Multiple Access (CDMA) service in 824~894 MHz bands commercialized in Korea, a CDMA service in 1750~1870 MHz bands, a CDMA service in 832~925 MHz bands commercialized in Japan, a Personal Communications Service (PCS) service in 1850~1990 MHz bands commercialized in the U.S.A, a Global System for Mobile communications (GSM) service in 880~960 MHz bands commercialized in Europe, China, etc., a Digital Cellular System (DCS) service in 1710~4880 MHz bands commercialized in some regions of Europe. In order to accommodate such multiple bands, a multi-band antenna having broadband characteristics is required.

However, according to research results in which a bandwidth is decreased in proportion to a decrease in a size of a multi-band antenna, a request for decreasing a size of a multi-band antenna and a request for providing broadband characteristics have a trade-off relation, and various attempts have been made to overcome such problem.

Meanwhile, a typical antenna used in a portable electronic device having a communication function include a Planar Inverted F Antenna (PIFA) or a monopole antenna as a basic structure, and a volume and the number of antennas to be mounted may be determined according to a service frequency and a bandwidth type. For example, a low frequency band of 700 MHz~900 MHz and a high frequency band of 1700 MHz~2100 MHz are used as a communication band.

For the monopole antenna, it is easy to obtain the broadband characteristics depending on a structure, but a matching characteristic deteriorates if an interval becomes closer to a ground in order to decrease an antenna size. In addition, for the PIFA, although it is easy to improve the matching characteristic by using a ground pin, as a result, it is difficult to obtain the broadband characteristics.

Accordingly, in order to overcome such a limitation while maintaining a basic monopole and PIFA shape, patterns with various shapes have been attempted, and various methods have been applied such as a method of decreasing a size by using a chip antenna, a matching method using a lumped element, and the like.

However, when a multi-band antenna is implemented that is smaller in size and has a broadband operation, a radiation efficiency characteristic generally deteriorates.

In addition, the multi-band antenna must satisfy various wireless communication services such as Long Term Evolution (LTE), Bluetooth® (BT), Global Positioning System (GPS), and Wireless Fidelity (WIFI). The multi-band antenna must satisfy the above-described communication band in a given antenna volume in a given electronic device, must have an electric field less than or equal to a Specific Absorption Rate (SAR) reference value for determining harmfulness to human body, and must overcome radiation performance interference caused by a metal enclosure, such as a metal frame or a Universal Serial Bus (USB).

An example for overcoming this includes a Metal Device Antenna (MDA) which utilizes a metal enclosure as a radiator, a bezel-antenna which utilizes a metal housing as a radiator, and the like.

In a current design trend, an electronic device uses an exterior metal frame structure, and there is a growing demand on such electronic device. However, applying a metal frame construction to an exterior case of the electronic device results in a growing problem of antenna radiation performance deterioration. In order to overcome this problem, a metal structure is avoided or the antenna is designed to be spaced apart from the metal structure. However, due to insufficient space for the antenna in the metal frame construction, it is difficult to overcome the performance problem.

In addition, with the advance of a communication technology, the electronic device must support additional operational frequency bands, and the space available to position the antenna is insufficient due when using the metal frame construction. Further, in view of current trends of designing the electronic device to be lighter, thinner, and simpler, antenna radiation performance may deteriorate due to the insufficient space available for the antenna.

In the electronic device using the exterior metal frame structure, it is difficult to ensure radiation performance due to a metal structure. Although the metal structure is avoided or an antenna is spaced apart in a design process in order to overcome this problem, since a space for the antenna is insufficient due to the metal frame construction, it is difficult to overcome the performance problem.

In addition, when the antenna is designed to avoid the metal frame structure, the electronic device using the exterior metal frame construction also has a structure in which the metal frame construction is utilized as a radiator due to a limitation of radiation performance improvement. However, the metal frame structure results in a difficulty to produce a multi-band resonance due to an insufficient space for the antenna and a constraint condition of a metal frame which can be utilized as the antenna.

In addition, it is difficult to overcome a human body influence caused when the metal frame is used as the radiator in the electronic device using the exterior metal frame structure.

SUMMARY

The present invention has been made to address the above-mentioned problems and disadvantages, and to provide at least the advantages described below. Accordingly, an antenna is provided that utilizes an exterior metal frame structure as an antenna radiator by connecting antenna feeding and ground portions to the exterior metal frames of the exterior metal frame structure. The antenna adjusts a resonance of a desired band by connecting an additional radiator to a metal frame to a slit length formed between the exterior metal frame and an internal Printed Circuit Board (PCB) or an internal metal bracket of a support structure. In addition, the antenna utilizes a slit formed between a metal frame and the internal PCB or the internal bracket as a radiator. The antenna produces multiple resonances and provides improved radiation performance.

In accordance with an aspect of the present invention, an antenna of an electronic device is provided that includes a Printed Circuit Board (PCB); a plurality of segment-type exterior metal frames spaced apart from the PCB; a feeding portion connected to one metal frame of the plurality of segment-type exterior metal frames; and a slit located between the PCB and the one metal frame, wherein the one metal frame operates with radiation through the feeding portion, or the slit operates with radiation, or another exterior metal frame operates with radiation through the feeding portion.

In accordance with another aspect of the present invention, an antenna is provided that includes a Printed Circuit Board (PCB); a plurality of exterior metal frames separated from the PCB and having a structure in which each of the plurality of exterior metal frames are segmented from each other; a feeding portion connected to one metal frame of the plurality of exterior metal frames; a slit located between the PCB and one side exterior metal frame; and a switch for selectively operating one metal frame of the plurality of exterior metal frames, wherein the one metal frame through the switch operates with radiation, or the slit operates with radiation, or another metal frame through the switch operates with radiation.

In accordance with another aspect of the present invention, an electronic device is provided that includes a main body; a plurality of segment-type exterior metal frames covering at least two side surfaces of the main body; a Printed Circuit Board (PCB) separated from the plurality of segment-type exterior metal frames, with the PCB provided in the main body; a feeding portion connected to one metal frame of the plurality of segment-type exterior metal frames; and a slit located between the PCB and the one metal frame, wherein the one metal frame fed through the feeding portion operates with radiation, or the slit operates with radiation, or another exterior metal frame fed through the feeding portion operates with radiation.

BRIEF DESCRIPTION OF THE DRAWINGS

The above and other aspects, features and advantages of the present invention will become more apparent from the following detailed description taken in conjunction with the accompanying drawings, in which.

DETAILED DESCRIPTION OF THE EMBODIMENTS OF THE PRESENT INVENTION

Figure 1:
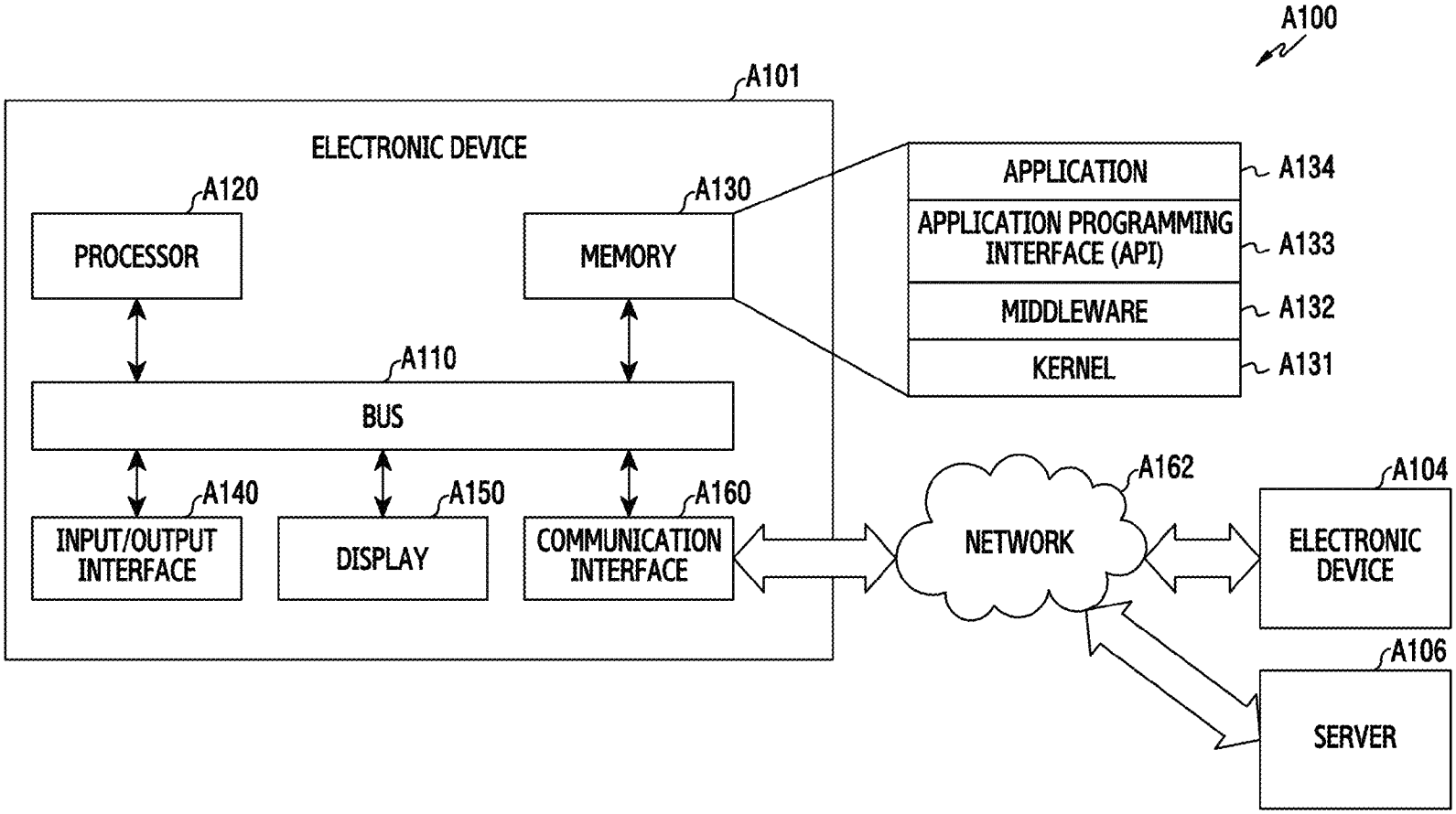
FIG. 1 is a block diagram illustrating a network environment including an electronic device according to an embodiment of the present invention.

Herein, embodiments of the present invention are described with reference to the accompanying drawings. Although specific embodiments of the present invention are illustrated in the drawings and relevant detailed descriptions are provided, various changes can be made and various embodiments may be provided. Accordingly, various embodiments of the present invention are not limited to the specific embodiments and should be construed as including all changes and/or equivalents or substitutes included in the ideas and technological scopes of embodiments of the present invention. In the explanation of the drawings, similar reference numerals are used for similar elements.

The terms "include" or "may include" used in describing the embodiments of the present invention indicate the presence of corresponding functions, operations, elements, and the like, and do not limit additional functions, operations, elements, and the like. In addition, it should be understood that the terms "include" or "have" used in describing the embodiments of the present invention indicate the presence of features, numbers, steps, operations, elements, parts, or a combination thereof described in the specifications, and do not preclude the presence or addition of one or more other features, numbers, steps, operations, elements, parts, or a combination thereof.

The term "or" used in describing the embodiments of the present invention include any and all combinations of words enumerated with it. For example, "A or B" means including A, including B, or including both A and B.

Although terms such as "first" and "second" used in describing the various embodiments of the present invention may modify various elements of the various embodiments, these terms do not limit the corresponding elements. For example, these terms do not limit an order and/or importance of the corresponding elements. These terms may be used for the purpose of distinguishing one element from another element. For example, a first electronic device and a second electronic device each indicate electronic devices and may indicate different electronic devices. For example, a first element may be referred to as a second element without departing from the scope of the various embodiments of the present invention, and similarly, a second element may be referred to as a first element.

It will be understood that, when an element is mentioned as being "connected" or "coupled" to another element, the element may be directly connected or coupled to another element, and there may be an intervening element between the element and another element. To the contrary, it will be understood that, when an element is mentioned as being "directly connected" or "directly coupled" to another element, an intervening element does not exist between the element and another element.

The terms used in describing the various embodiments of the present invention are for the purpose of describing specific embodiments only and are not intended to limit embodiments of the present invention. As used herein, the singular forms are intended to include the plural forms as well, unless the context clearly indicates otherwise. All of the terms used herein including technical or scientific terms have the same meanings as those generally understood by those or ordinary skill in the art unless otherwise defined. The terms defined in a generally used dictionary should be interpreted as having the same meanings as the contextual meanings of the relevant technology and should not be interpreted as having ideal or exaggerated meanings unless they are clearly defined herein.

An electronic device according to embodiments of the present invention includes a device that is equipped with a communication function. For example, the electronic device may include at least one of a smartphone, a tablet personal computer (PC), a mobile phone, a video phone, an electronic book reader, a desktop PC, a laptop PC, a netbook computer, a Personal Digital Assistant (PDA), a Portable Multimedia Player (PMP), an MP3 player, a mobile medical machine, a camera, or a wearable device (for example, a head-mounted-device (HMD) such as electronic glasses, electronic clothing, an electronic bracelet, an electronic necklace, an electronic accessory, electronic tattoos, or a smart watch).

The electronic device according to embodiments of the present invention includes one or a combination of one or more of the above-mentioned devices. In addition, the electronic device according to embodiments of the present invention may be a flexible device. In addition, one of ordinary skill in the art will recognize that the electronic device according to embodiments of the present invention is not limited to the above-mentioned devices.

Hereinafter, an electronic device according to embodiments is explained with reference to the accompanying drawings. The term "user" used in describing the embodiments may refer to a person who uses the electronic device or a device that uses the electronic device (for example, an artificial intelligence electronic device).

FIG. 1 is a block diagram illustrating a network environment A100 including an electronic device according to an embodiment of the present invention. Referring to FIG. 1, the electronic device A101 includes a bus A110, a processor A120, a memory A130, an input and output interface A140, a display A150, and a communication interface A160.

The bus A110 may be a circuit which connects the above-described elements with one another and transmits communication (for example, a control message) between the above-described elements.

The processor A120 receives instructions from the other elements (for example, the memory A130, the input and output interface A140, the display A150, the communication interface A160, and the like) via the bus A110, deciphers the instructions, and performs calculation and/or data processing according to the deciphered instructions.

The memory A130 stores instructions or data received from or generated by the processor A120 or the other elements (for example, the input and output interface A140, the display A150, the communication interface A160, and the like). For example, the memory A130 may include programming modules such as a kernel A131, middleware A132, an Application Programming Interface (API) A133, an application A134, and the like. Each of the above-described programming modules may be configured by software, firmware, hardware, or a combination of two or more of them.

The kernel A131 controls or manages system resources (for example, the bus A110, the processor A120, the memory A130, and the like) which are used for performing operations or functions implemented in the other programming modules, for example, the middleware A132, the API A133, or the application A134. In addition, the kernel A131 may provide an interface for allowing the middleware A132, the API A133, or the application A134 to access an individual element of the electronic device A101 and control or manage the element.

The middleware A132 serves as an intermediary to allow the API A133 or the application A134 to communicate with the kernel A131 and exchanges data with the kernel A131. In addition, the middleware A132 controls, e.g., schedules or load balances, work requests received from the application A134, for example, by giving priority to use the system resources of the electronic device A101 to at least one application.

The API A133 may be an interface for allowing the application A134 to control a function provided by the kernel A131 or the middleware A132, and, for example, may include at least one interface or function (for example, instructions) for controlling a file, controlling a window, processing an image, or controlling text.

According to the embodiments, the application A134 may include a Short Message Service (SMS)/Multimedia Messaging Service (MMS) application, an email application, a calendar application, a notification application, a health care application (for example, an application for measuring exercise or a blood sugar level), an environment information application (for example, an application for providing information on atmospheric pressure, humidity, or temperature), and the like. Additionally or alternatively, the application A134 may be an application related to information exchange between the electronic device A101 and an external electronic device (for example, an electronic device A104). For example, the application related to the information exchange may include a notification relay application for relaying specific information to an external electronic device or a device management application for managing an external electronic device.

For example, the notification relay application may include a function of relaying notification information generated by other applications of the electronic device A101 (for example, the SMS/MMS application, the email application, the health care application, the environment information application, and the like) to the external electronic device A104. Additionally or alternatively, the notification relay application may receive notification information from the external electronic device A104 and may provide the same to a user. For example, the device management application may manage (for example, install, delete or update) a function regarding at least part of the external electronic device A104 communicating with the electronic device A101 (for example, turning on/off the external electronic device (or some parts) or adjusting brightness (or resolution) of a display), an application operating in the external electronic device or a service provided by the external electronic device (for example, a calling service or a message service).

According to various embodiments, the application A134 may include an application which is specified according to the attribute (for example, a type of electronic device) of the external electronic device A104. For example, when the external electronic device is an MP3 player, the application A134 may include an application related to replay music. Similarly, when the external electronic device is a mobile medical device, the application A134 may include an application related to health care. According to an embodiment, the application A134 may include at least one of an application specified by the electronic device A101 or an application received from the external electronic device A104 or the server A106.

The input and output interface A140 may transmit instructions or data inputted by a user through an input and output device (for example, a sensor, a keyboard or a touch screen) to the processor A120, the memory A130, or the communication interface A160 through the bus A110, for example. For example, the input and output interface A140 may provide data on a user's touch inputted through a touch screen to the processor A120. In addition, the input and output interface A140 may output instructions or data received from the processor A120, the memory A130, or the communication interface A160 through the bus A110 through the input and output device (for example, a speaker or a display). For example, the input and output interface A140 may output voice data processed through the processor A120 to the user through a speaker.

The display A150 may display a variety of information (for example, multimedia data, text data, and the like) to the user.

The communication interface A160 enables communication between the electronic device A101 and the external electronic device A104 or the server A106. For example, the communication interface A160 may be connected to a network A162 via wireless communication or wire communication to communicate with the external device. The wireless communication may include at least one of WiFi, BT, NFC, GPS, or cellular communication (for example, LTE, LTE-A, CDMA, WCDMA, UMTS, WiBro, GSM, and the like). The wire communication may include at least one of a USB, a High Definition Multimedia Interface (HDMI), a Recommended Standard 232 (RS-232), or plain old telephone service (POTS).

According to the embodiments, the network A162 may be a telecommunications network. The telecommunications network may include at least one of a computer network, Internet, Internet of Things, or a telephone network. According to an embodiment, a protocol for communicating between the electronic device A101 and the external device (for example, a transport layer protocol, a data link layer protocol or a physical layer protocol) may be supported in at least one of the application A134, the application programming interface A133, the middleware A132, the kernel A131, or the communication interface A160.

Figure 2:
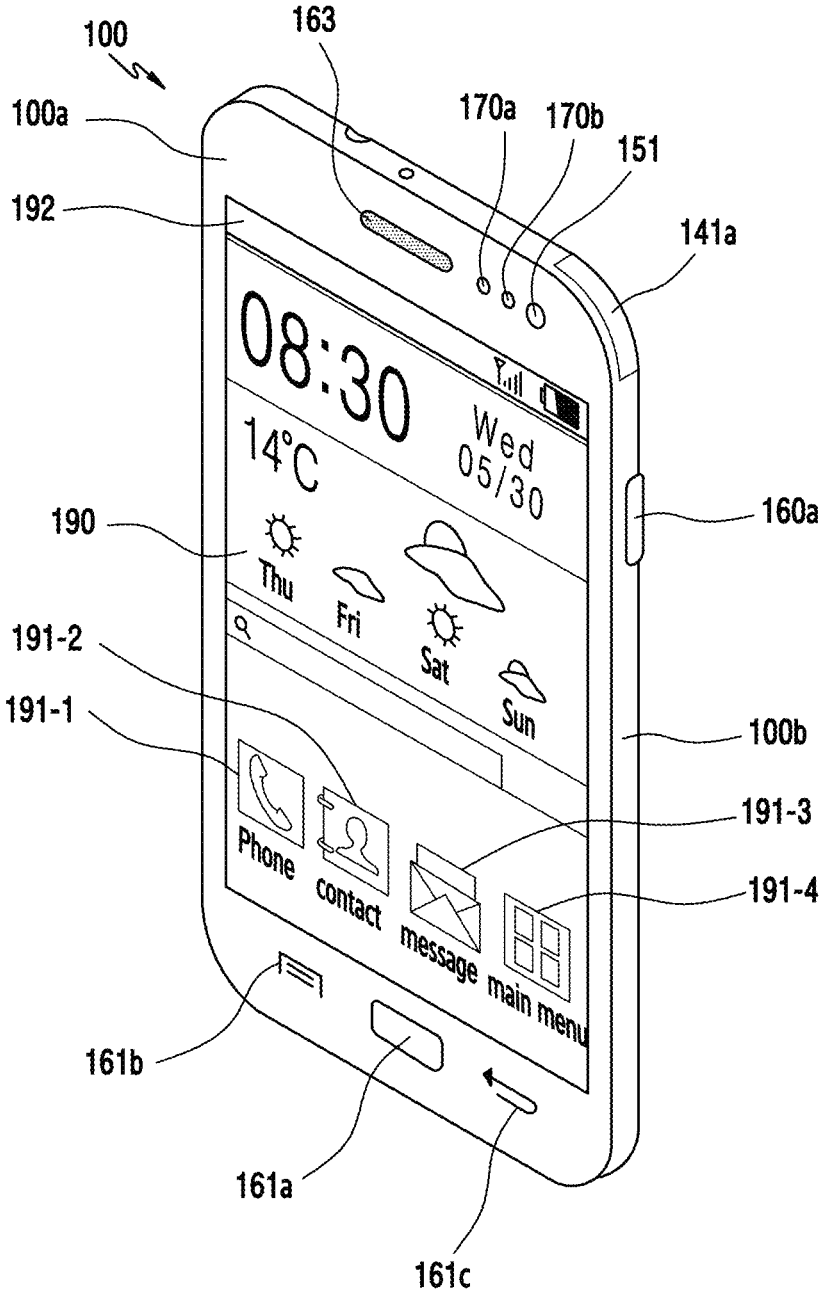
FIG. 2 is a front perspective view of an electronic device according to an embodiment of the present invention.
Figure 3:
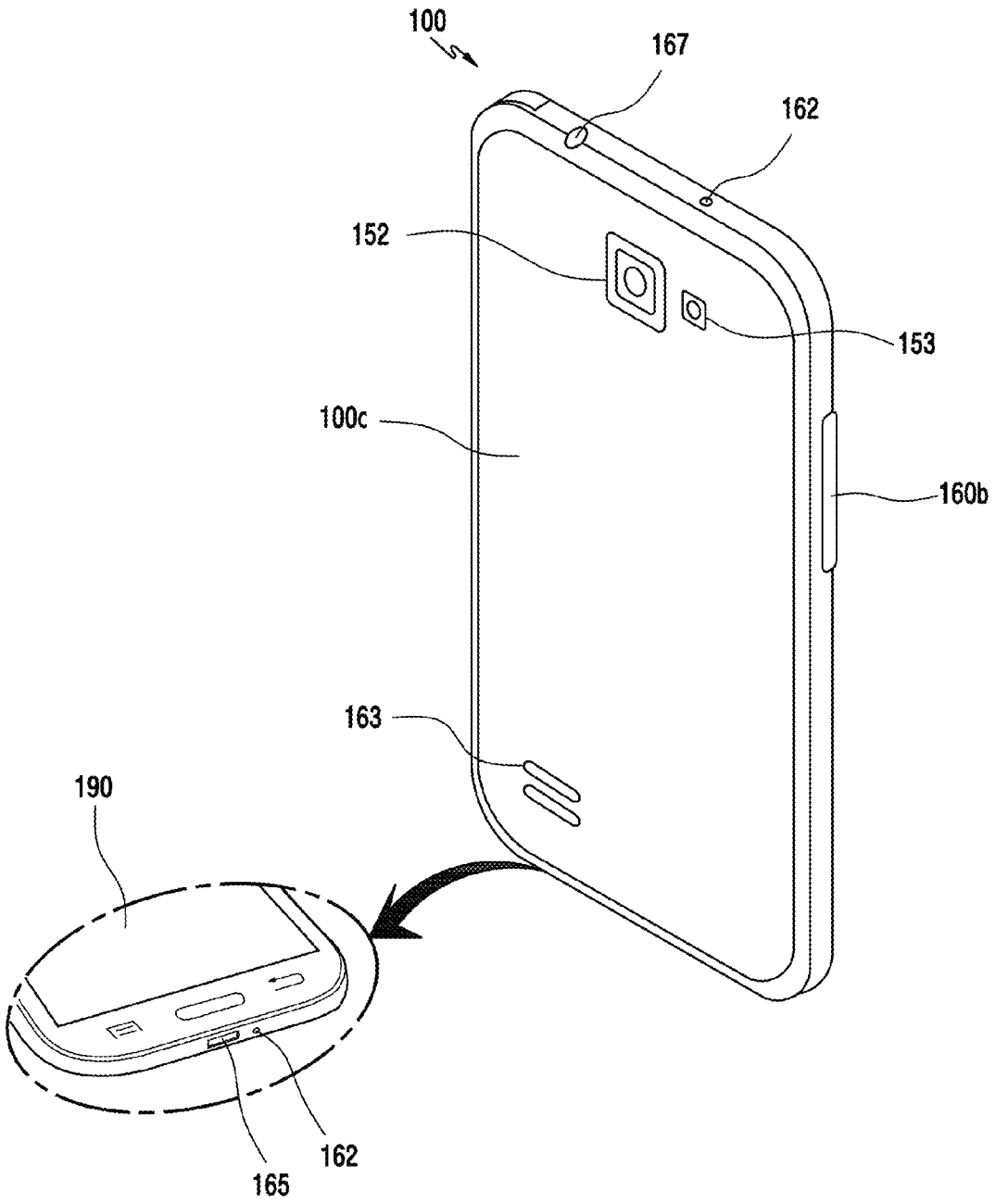
FIG. 3 is a rear perspective view of an electronic device according to an embodiment of the present invention.

FIG. 2 is a front perspective view of an electronic device according to an embodiment of the present invention. FIG. 3 is a rear perspective view of the electronic device according to an embodiment of the present invention.

Referring to FIG. 2 and FIG. 3, a touch screen 190 is disposed to a center of a front surface 100*a* of an electronic device 100. The touch screen 190 is formed in a large size to occupy a majority part of the front surface 100*a* of the electronic device 100. An example in which a main home screen is displayed on the touch screen 190 is shown in FIG. 2. The main home screen is a first screen displayed on the touch screen 190 when the electronic device 100 is powered on. In addition, when the electronic device 100 has different home screens with several pages, the main home screen may be a first home screen among the home screens with the several pages. Shortcut icons 191-1, 191-2, and 191-3 for executing frequently used applications may be displayed on the home screen, as well as a main menu switching key 191-4, time, weather, and the like. The main menu switching key 191-4 displays a menu screen on the touch screen 190. In addition, an upper end of the touch screen 190 may be formed with a status bar 192 for displaying a status of the device 100, such as a battery charging status, received signal strength, and a current time. A bottom portion of the touch screen 190 may be formed with a home button 161*a*, a menu button 161*b*, and a back button 161*c*.

The home button 161*a* is used to display the main home screen to the touch screen 190. For example, if the home key 161*a* is touched when any home screen other than the main home screen or a menu screen is displayed on the touch screen 190, the main home screen may be displayed on the touch screen 190. In addition, if the home button 161*a* is touched while applications are executed on the touch screen 190, the main home screen of FIG. 2 may be displayed on the touch screen 190. In addition, the home button 161*a* may be used to display recently used applications on the touch screen 190 or to display a task manager.

The menu button 161*b* provides a linked menu that can be displayed on the touch screen 190. The linked menu may include a widget addition menu, a background screen change menu, a search menu, an edit menu, an environment configuration menu, and the like. The back button 161*c* may display a screen executed immediately previous to a currently executed screen, or may terminate the most recently used application.

A first camera 151, an illumination sensor 170*a*, and a proximity sensor 170*b* may be disposed on an edge of the front surface 100*a* of the electronic device 100. As shown in FIG. 3, a second camera 152, a flash 153, and a speaker 163 are disposed to a rear surface 100*c* of the electronic device 100.

For example, a power/reset button 160*a*, a sound volume button 160*b*, a terrestrial Digital Multimedia Broadcasting (DMB) antenna 141*a* for receiving broadcast signals, one or more microphones 162, and the like may be disposed to a side surface 100*b* of the electronic device 100. The DMB antenna 141*a* may be fixed to the electronic device 100, or may be formed in a detachable manner.

In addition, a connector 165 is formed to a bottom side surface of the electronic device 100. A plurality of electrodes are formed to the connector 165, and may be connected to an external device in a wired manner. An earphone connection jack 167 may be disposed to an upper side surface of the electronic device 100. An earphone may be inserted to the earphone connection jack 167. The earphone connection jack 167 may also be disposed to a bottom side surface of the electronic device 100.

The electronic device 100 has a front surface, a rear surface, and a plurality of side surfaces. An exterior of the electronic device 100 consists of the front surface, the rear surface, and the side surfaces. Portions excluding the front surface and the rear surface are the side surfaces, and the side surfaces include an upper side surface, one side surface, another side surface, and a bottom side surface. A touch screen is disposed on the front surface. A battery cover is disposed on the rear surface. An exterior metal frame is disposed on the side surface. The exterior metal frame covers the side surface, in an integrated or segmented manner. The exterior metal frame may be formed by injection molding.

An antenna structure using an exterior metal frame mounted on a side surface of an exterior of the electronic device is described herein.

Figure 4:
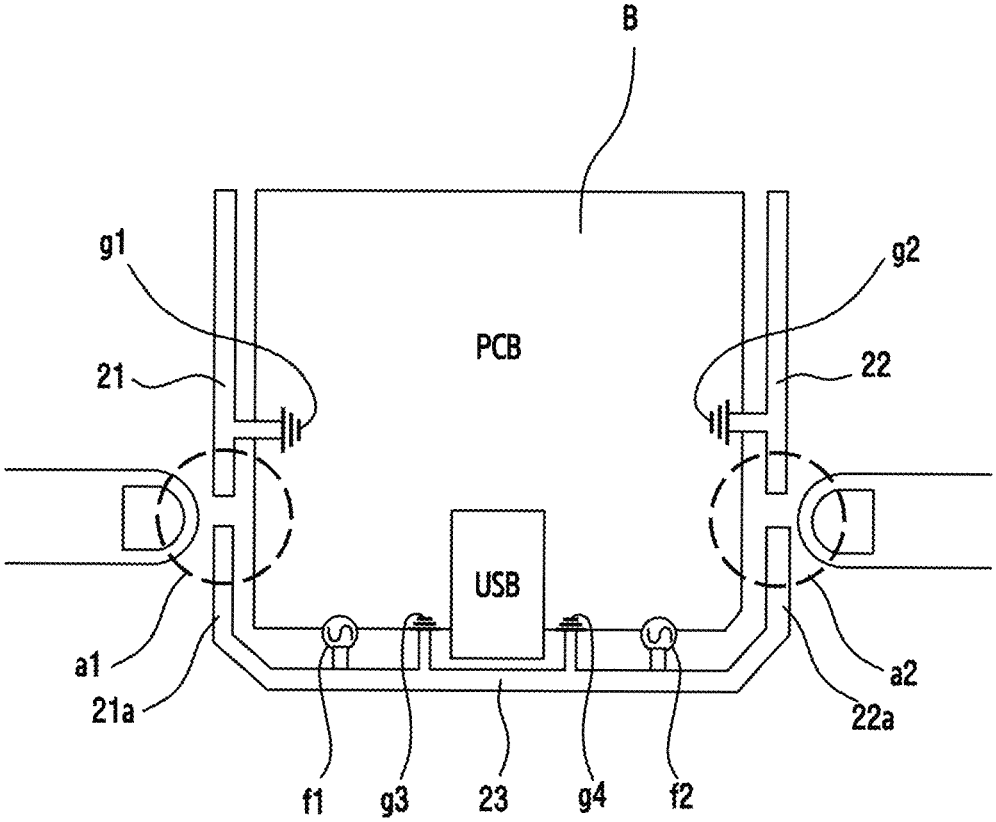
FIG. 4 illustrates an antenna structure using an exterior metal frame employed in an electronic device according to an embodiment of the present invention.

FIG. 4 illustrates an antenna structure using an exterior metal frame employed in an electronic device according to an embodiment of the present invention.

Referring to FIG. 4, the antenna structure includes side metal frames 21*a* and 22*a* and a bottom metal frame 23 that are utilized as a radiator to improve radiation performance of an electronic device, with the side metal frames 21*a* and 22*a* and the bottom metal frame 23 included in a structure of exterior metal frames 21, 22, and 23. Accordingly, a metal frame construction exists along two side surfaces, with the metal frame construction segmented to form an open space that is utilized for radiation. The bottom exterior metal frame 23 of the antenna according to the embodiment may be connected to a Printed Circuit Board (PCB) B by each of feeding portions f1 and f2. Each of the exterior metal frames 21, 22, and 23 is grounded to the PCB B at respective ground points g1, g2, g3, and g4.

However, such an antenna structure has a problem of antenna performance deterioration, including a human body effect when the electronic device is gripped by a user at grip points a1 and a2 of side metal frame segment portions.

Figure 5:
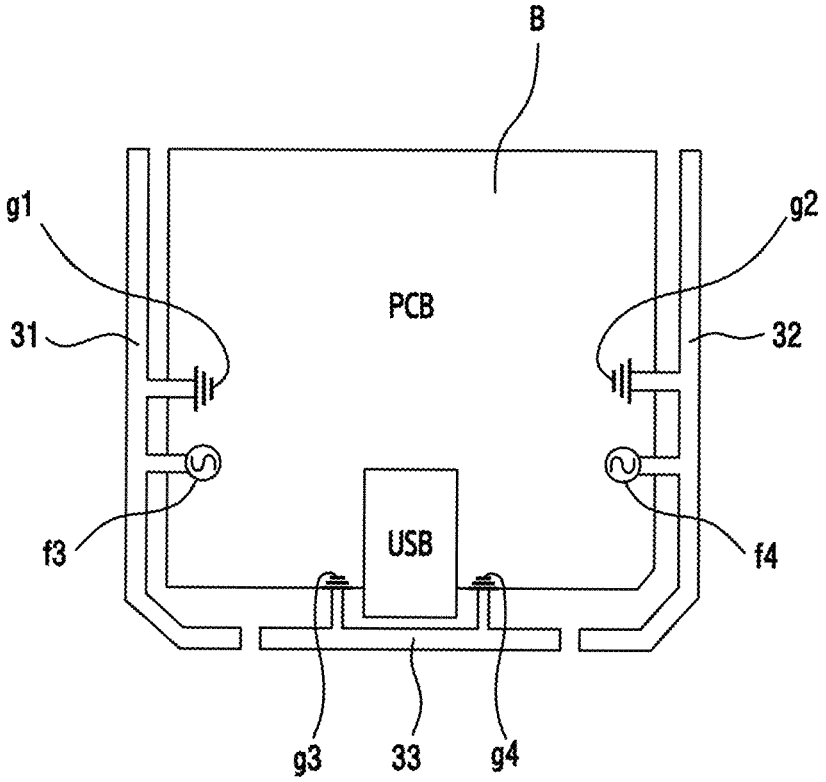
FIG. 5 illustrates an antenna structure using an exterior metal frame employed in an electronic device according to an embodiment of the present invention.

FIG. 5 illustrates an antenna structure using an exterior metal frame employed in an electronic device according to an embodiment of the present invention.

Referring to FIG. 5, the antenna structure includes an exterior metal frame segment portion that is moved to a bottom metal frame 33, which is difficult for a user to grip, so that the open space that is utilized for radiation is not touched when a user grips the electronic device that includes a structure of exterior metal frames 31, 32, and 33. Each of the exterior metal frames 31, 32, and 33 is grounded to a PCB B at respective ground points g1, g2, g3, and g4.

However, in such antenna structure, since feeding portions f3 and f4 are connected to side metal frames 31 and 32, respectively, and the side metal frames 31 and 32 operate as a radiator, a user is directly contacting the antenna when gripping the electronic device. Improvements that address the influence of a hand, body, and other parts of the user are disclosed herein.

An antenna structure according to the embodiments of the present invention is described with reference to FIG. 6A to FIG. 13.

The antenna according to the embodiments of the present invention has a structure which overcomes antenna radiation performance deterioration in an electronic device using an exterior metal frame construction, which is used for antenna radiation.

In an embodiment of the present invention, the antenna is a multi-band operation antenna in which power is fed to the exterior metal frame construction so that an exterior metal frame directly operates as a radiator, and a slit is formed between the metal frame and an internal PCB or an internal bracket having a support structure. The slit or the metal frame operates with radiation, so that the radiation is produced on a slit antenna or a loop antenna.

In addition, an environment of the network A162 (FIG. 1) is determined through the communication interface A160, to regulate a switch control signal by delivering the switch control signal to a switch in accordance with a band determined by the communication interface A160, the server A106, or the processor.

Figure 6A:
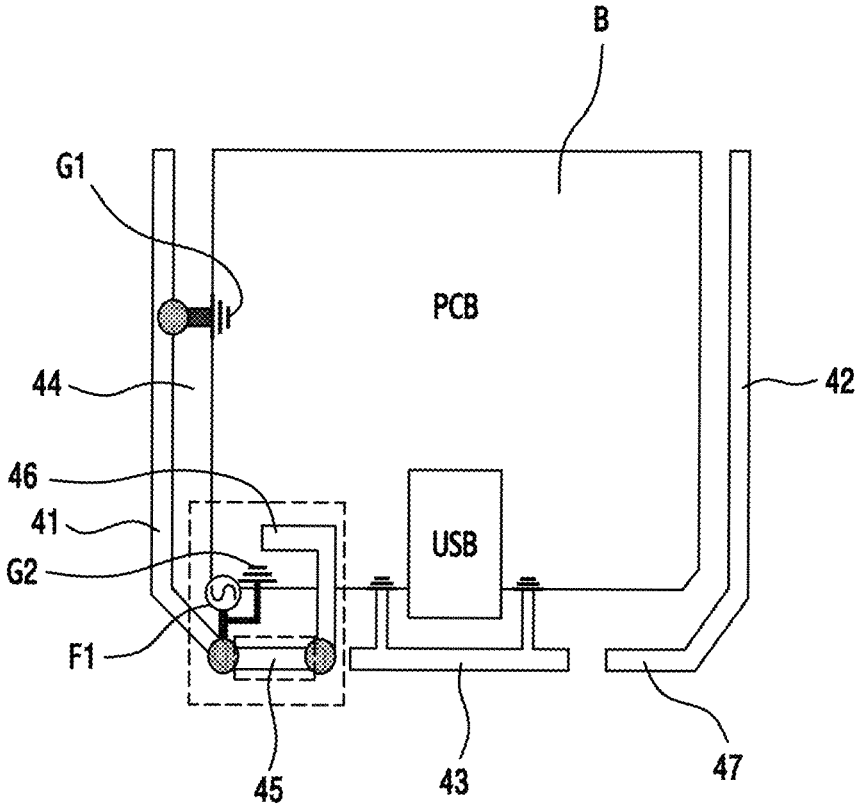
FIG. 6A illustrates an antenna structure using an exterior metal frame according to an embodiment of the present invention, with the antenna using an additionally connected radiator to adjust a resonant length.
Figure 6B:
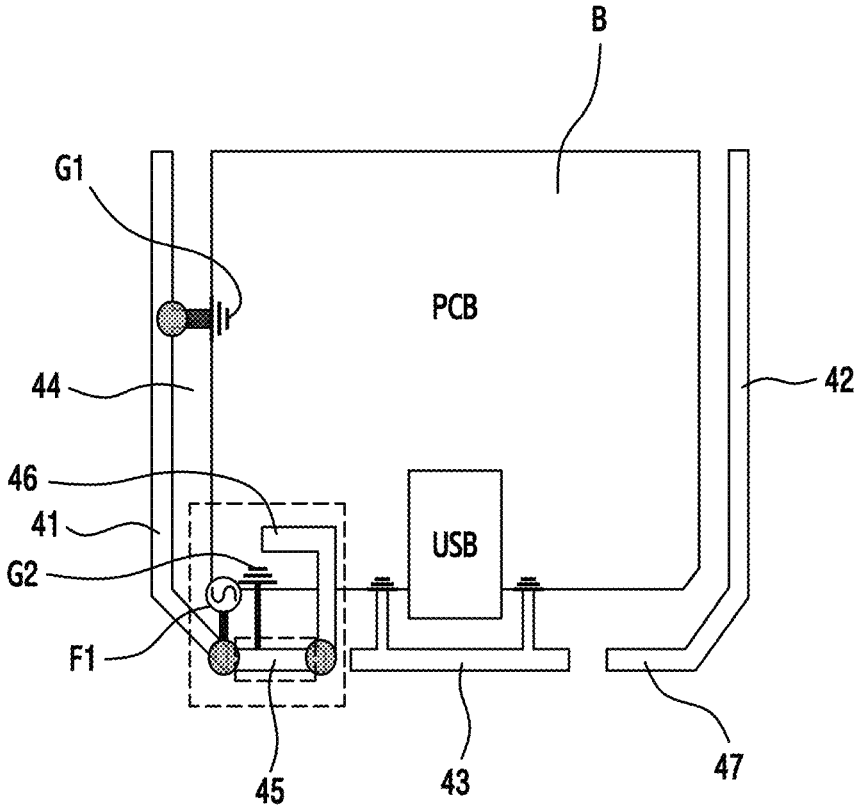
FIG. 6B illustrates an antenna structure using an exterior metal frame according to an embodiment of the present invention.
Figure 6C:
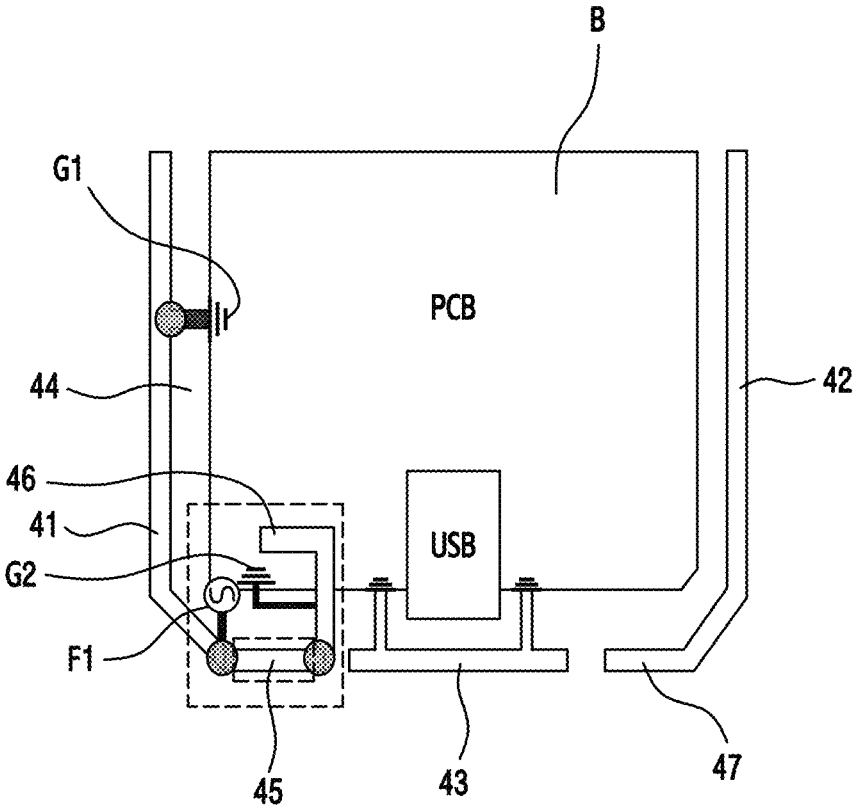
FIG. 6C illustrates an antenna structure using an exterior metal frame according to an embodiment of the present invention.
Figure 7:
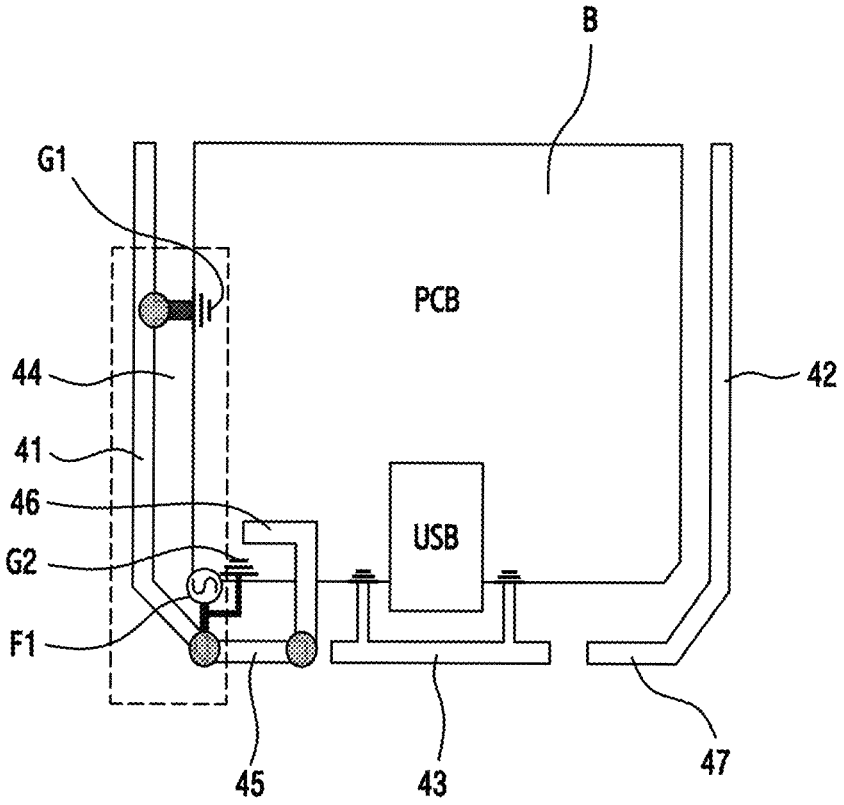
FIG. 7 illustrates an antenna structure using an exterior metal frame according to an embodiment of the present invention, with the antenna using a slit length to adjust a resonant length.

FIGS. 6A-6C illustrate an antenna structure using an exterior metal frame according to an embodiment of the present invention in which the antenna adjusts a resonant length by connecting an additional radiator. FIG. 7 illustrates an antenna structure using an exterior metal frame according to an embodiment of the present invention in which the antenna adjusts a resonant length by using a slit length between a side exterior metal frame 41 and an internal PCB B, which form a slit.

Referring to FIGS. 6A-6C and FIG. 7, the antenna has a structure in which a feeding portion F1 to an exterior metal frame is provided, and exterior metal frames 41 and 45 to which power is fed are used as a radiator. The antenna includes a plurality of exterior metal frames 41, 42, 43, 45, and 47 placed around an exterior of the electronic device, the PCB B, the feeding portion F1, and a slit 44. The antenna may be disposed along upper or bottom portions of the electronic device. In the present example, the antenna is disposed along the bottom portion of the electronic device.

The PCB B, which is placed inside a main body of the electronic device, has a plurality of components mounted thereon, and includes a metal material or a ground surface.

The exterior metal frames include one side exterior metal frame 41 and bottom exterior metal frames 43, 45, and 47, with the frames segmented from each other. The electronic device has a front surface, a rear surface, and a plurality of side surfaces. The plurality of side surfaces include an upper side surface, a bottom side surface, one side surface, and another side surface (FIGS. 2-3). The side exterior metal frame 41 may be an exterior metal frame located in one side surface of the electronic device. The bottom exterior metal frames 43, 45, and 47 may be an exterior metal frame located in a bottom side surface of the electronic device. The exterior metal frames 41, 42, 43, 45, and 47 are formed of metal and perform an antenna function while serving for a part of an exterior of the electronic device.

The bottom exterior metal frame includes the bottom center exterior metal frame 43, a bottom first-side exterior metal frame 45 disposed to one side of the bottom center exterior metal frame 43, and a bottom second-side exterior metal frame 47 disposed to another side of the bottom center exterior metal frame 43, and with the frames segmented from each other. Further, the side exterior metal frame 41 is directly connected to the bottom first-side exterior metal frame 45 in an integrated manner.

As a component to be used as a radiator by feeding power to the exterior metal frame, the feeding portion F1 is disposed near a bottom portion of the electronic device, more specifically, a portion between the side exterior metal frame 41 and the bottom first-side exterior metal frame 45.

The side exterior metal frame 41 operates as a radiator of power fed through the feeding portion F1, or the bottom first-side exterior metal frame 45 operates as the radiator of power fed through the feeding portion F1. To adjust a resonant length of the antenna, the side exterior metal frame 41 and the bottom first-side exterior metal frame 45 are not identical.

The slit 44 is uniformly provided between the side exterior metal frame 41 and the PCB B. When the side exterior metal frame 41 operates as the radiator, the resonant length can be adjusted by adjusting a length of the slit 44. The side exterior metal frame 41 is grounded at ground shorting point G1 to the PCB B. The resonant length can be adjusted according to a length of the slit 44 that exists between the ground shorting point G1 and the feeding portion F1. As described herein, a resonance point may move to a high band when the ground shorting point G1 is located close to the feeding portion F1.

Meanwhile, the bottom first-side exterior metal frame 45 has an additional radiator 46. The additional radiator 46 is formed with a conductive pattern on an additional antenna carrier or an enclosure cover connected with the metal frame. The additional radiator 46 is used to adjust the resonant length of the antenna. The additional radiator 46 is spaced apart from the PCB B, and may be formed on an antenna carrier, or on the front surface 100*a*, side surface 100*b*, or rear surface 100*c* having a function similar to the antenna carrier. The additional radiator 46 may be constructed of a metal material. The additional radiator 46 may be spaced apart in a vertical upward direction toward the PCB.

As a result, each of the side exterior metal frame 41 and the bottom first-side exterior metal frame 45 can independently adjust the resonant length. According to the aforementioned structure, when power is fed to the antenna by the feeding portion F1, the side exterior metal frame 41 will operate as a loop antenna or a slit antenna. The bottom first-side exterior metal frame 45 may operate as a PIFA together with the additional radiator 46.

Meanwhile, although the slit 44 is described above as being located between the side exterior metal frame 41 and the PCB B, the slit 44 may also be located between the side exterior metal frame 41 and an internal bracket. The internal bracket includes a metal material, configured to support the PCB B. Therefore, a location of the slit 44 may be limited to a location between the side exterior metal frame and the internal bracket. In other words, the location in which the PCB B is disposed may be the same as a location in which the internal bracket is disposed. The internal bracket may include a display bracket.

A connection of a ground portion G2 is described herein with reference to FIG. 6A to FIG. 6C.

Referring to FIG. 6A, the ground portion G2 is connected to a portion to which the side exterior metal frame 41 and the bottom first-side exterior metal frame 45 are connected. In particular, the ground portion G2 is directly connected to the portion to which the side exterior metal frame 41 and the bottom first-side exterior metal frame 45 are connected.

Referring to FIG. 6B, the ground portion G2 is connected to the bottom first-side exterior metal frame 45. In particular, the ground portion G2 is directly connected to the bottom first-side exterior metal frame 45.

Referring to FIG. 6C, the ground portion G2 is connected to the additional radiator 46. In particular, the ground portion G2 is directly connected to the additional radiator 46.

Figure 8:
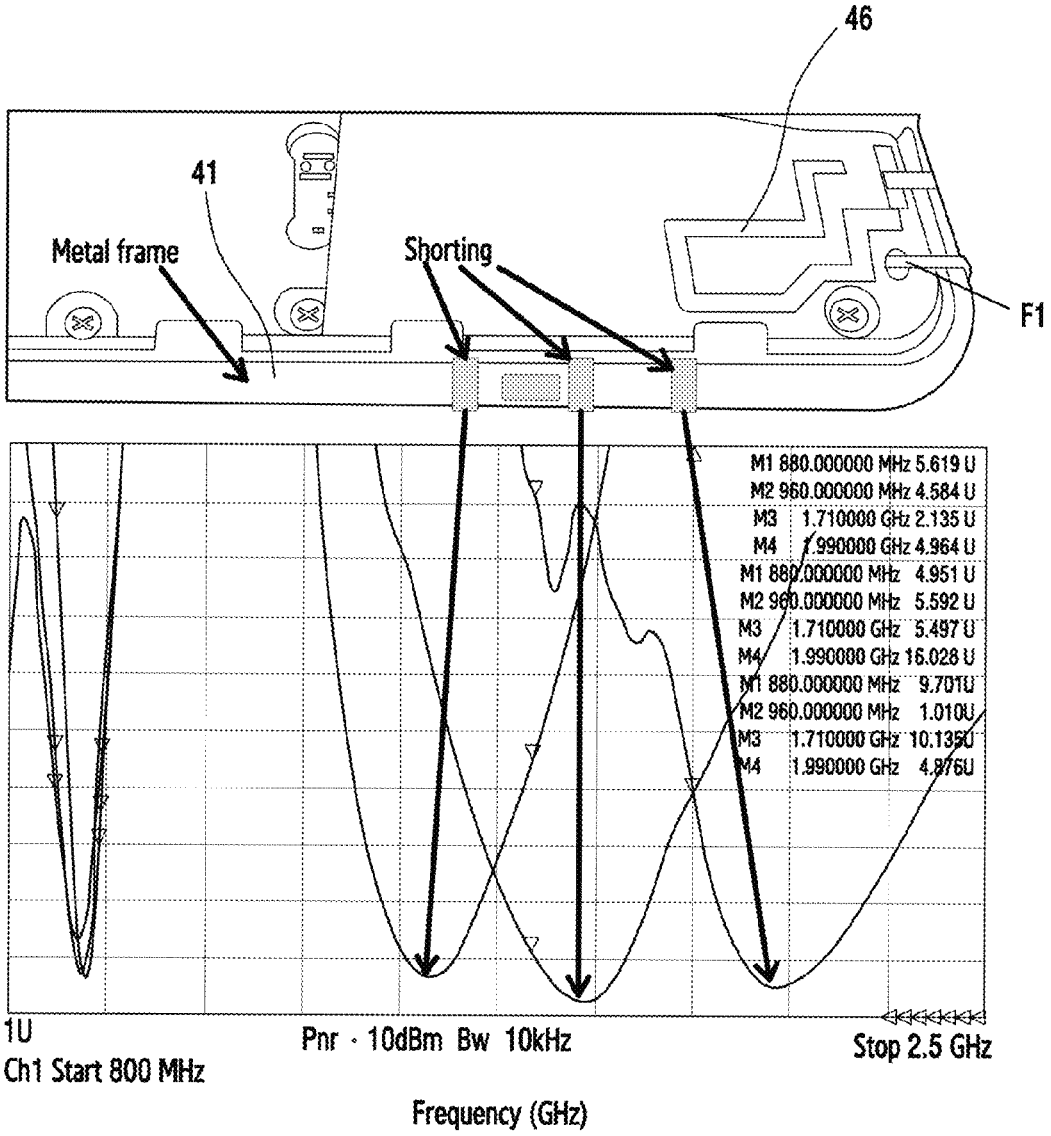
FIG. 8 is a side perspective view of an electronic device and a corresponding graph illustrating resonance moving to a high band depending on a location of a shorting point according to an embodiment of the present invention.

FIG. 8 is a side perspective view of an electronic device and corresponding graph providing examples of implementing metal frame radiation using a slit formed between a metal frame and an internal PCB or using a slit formed between a metal frame and an internal bracket having a support structure. In an antenna according to the embodiments of the present invention, a low-band resonance is implemented by connecting the additional radiator to the exterior metal frame, and a high-band resonance is implemented by using slit radiation. In the antenna according to the embodiments of the present invention, a Voltage Standing Wave Ratio (VSWR) can be confirmed in which a slit length is changed depending on a shorting point and thus a high-band resonance moves independently. The shorting points shown in FIG. 8 indicate band characteristics located at a distance of 30 mm, 40 mm, and 50 mm from the feeding portion. As shown in FIG. 8, the resonance moves to a high band when the shorting point is close to the feeding portion.

TABLE 1

| | EGSM | DCS | PCS |
|---|---|---|---|
| Passive Efficiency | 26.2% | 32.5% | 26% |

The chart included in FIG. 8 shows a passive efficiency of the antenna when a GSM/DCS/PCS band resonance is implemented in the antenna structure. In the antenna according to the embodiments of the present invention, it can be seen that a multi-band operation antenna in which a low band and a high band operate independently can be implemented through power feeding.

An antenna operating at multiple bands by feeding power to an exterior metal frame is described with reference to FIG. 9A to FIG. 11.

Figure 9A:
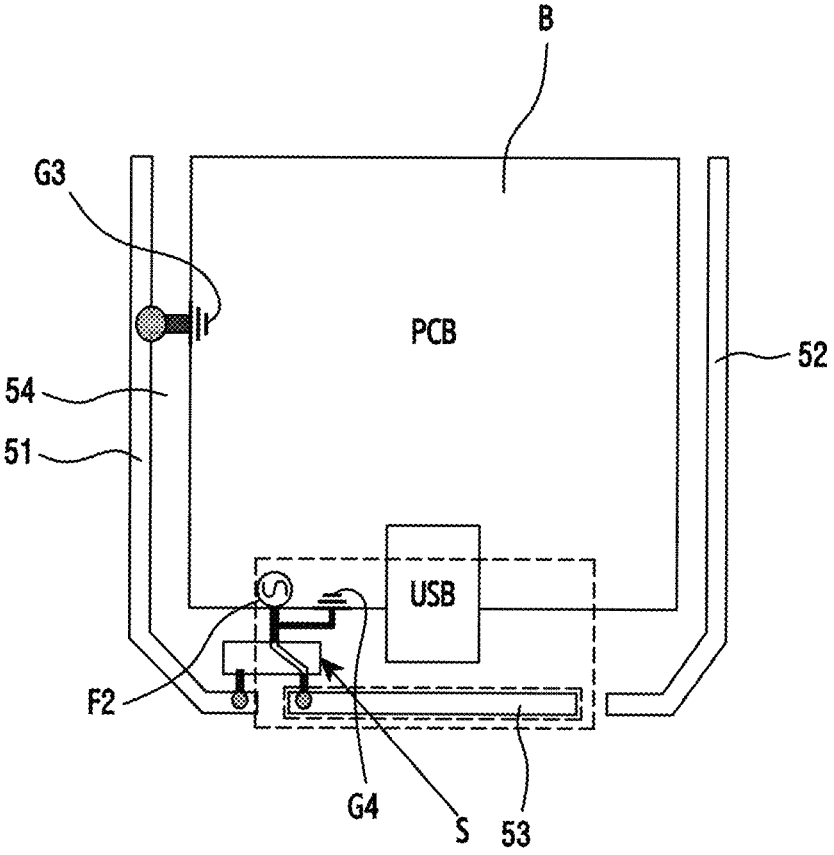
FIG. 9A illustrates an antenna structure in which a bottom center metal frame operates as a radiator through power feeding using a switch according to an embodiment of the present invention.
Figure 9B:
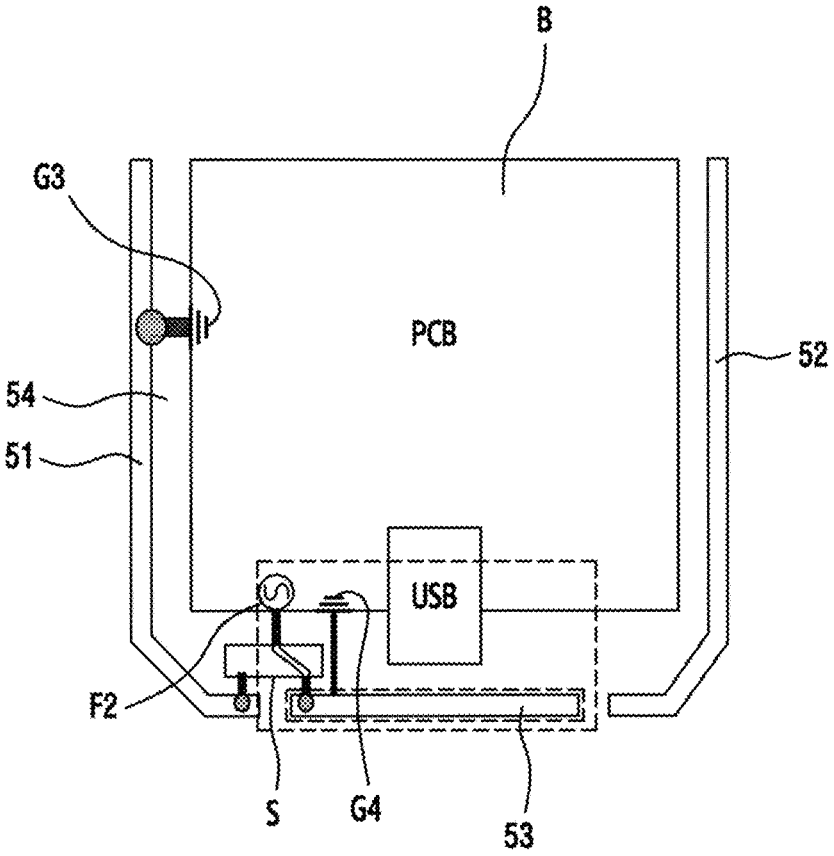
FIG. 9B illustrates an antenna structure in which a bottom center metal frame operates as a radiator through power feeding using a switch according to an embodiment of the present invention.
Figure 9C:
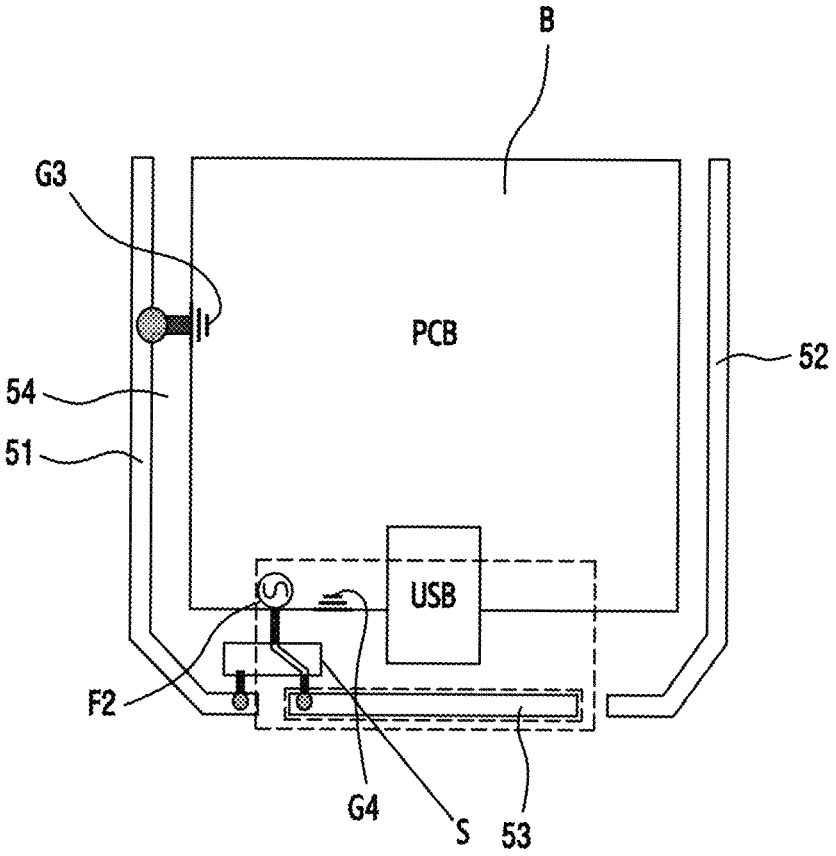
FIG. 9C illustrates an antenna structure in which a bottom center metal frame operates as a radiator through power feeding using a switch according to an embodiment of the present invention.
Figure 10A:
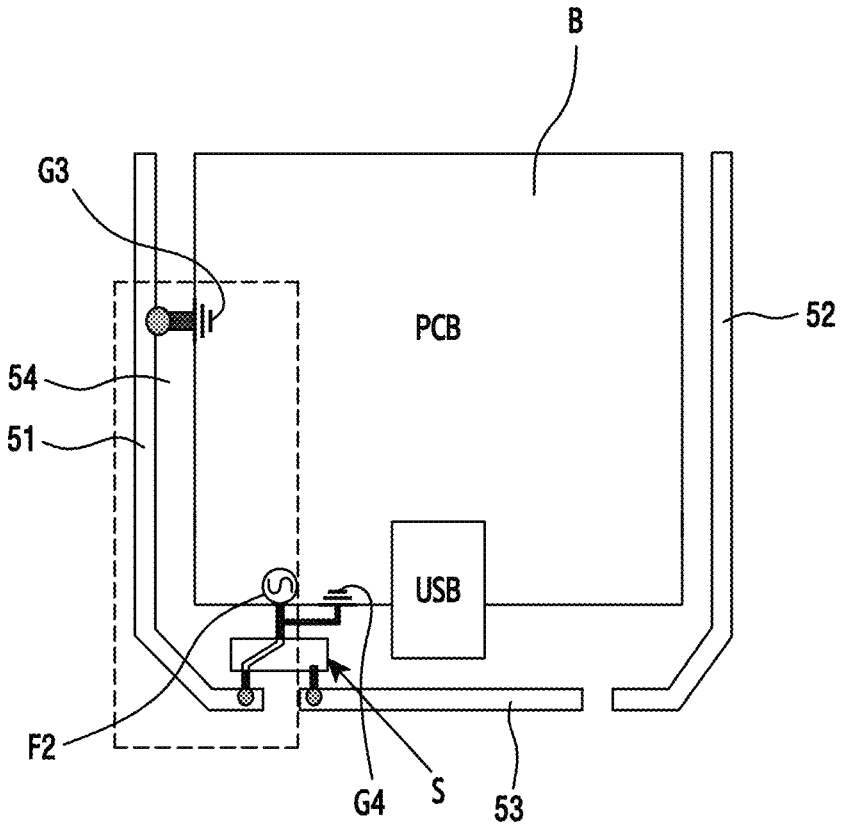
FIG. 10A illustrates an antenna structure in which radiation is produced on a slit between a side exterior metal frame and a Printed Circuit Board (PCB) through power feeding using a switch according to an embodiment of the present invention.
Figure 10B:
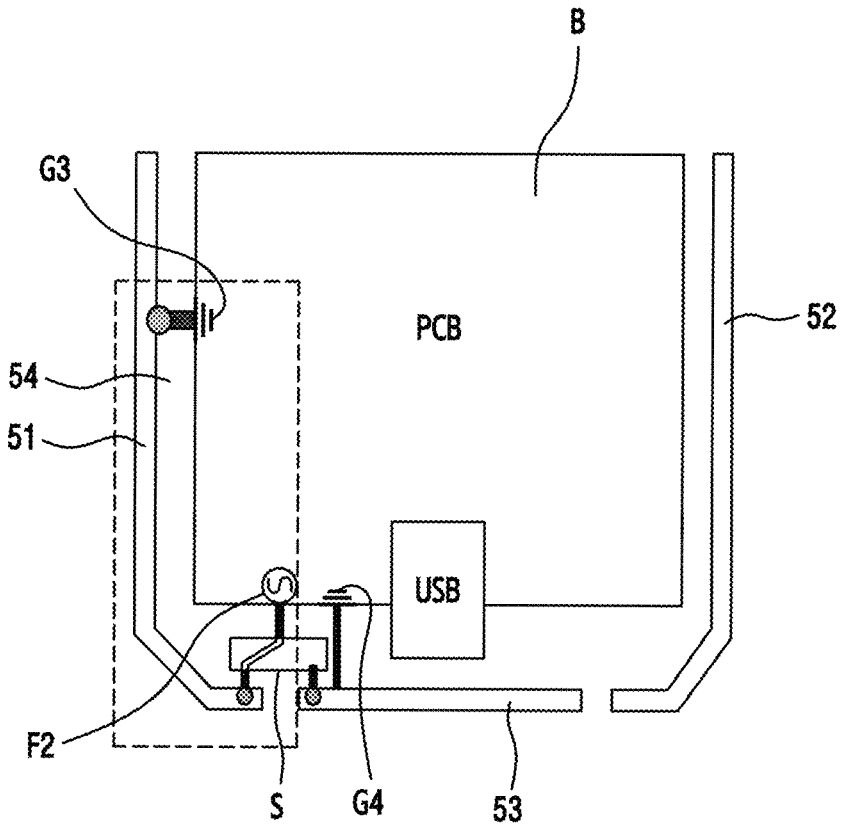
FIG. 10B illustrates an antenna structure in which radiation is produced on a slit between a side exterior metal frame and a PCB through power feeding using a switch according to an embodiment of the present invention.

FIGS. 9A-9C illustrate an antenna structure in which a bottom center metal frame operates as a radiator by power feeding through a switch according to an embodiment of the present invention. FIGS. 10A-10B illustrate an antenna structure in which radiation is produced on a slit between a side exterior metal frame and a PCB by feeding power through a switch according to an embodiment of the present invention.

Referring to FIG. 9A and FIG. 10A, an antenna is provided utilizing a feeding portion F2 to an exterior metal frame, and configured with a structure in which radiation is produced selectively by using a switch S. The antenna according to the embodiments of the present invention may include a plurality of exterior metal frame 51, 52, and 53 placed around an exterior of the electronic device, the PCB B, the feeding portion F2, a slit 54, and the switch S. The antenna is disposed in a bottom and an upper portion of the electronic device in FIG. 9A and FIG. 10A, respectively.

The exterior metal frames include the single side exterior metal frame 51 and the bottom center exterior metal frame 53, and have a structure in which the frames are segmented from each other. The electronic device has a front surface, a rear surface, and a plurality of side surfaces.

As a component to be used as a radiator by feeding power to the exterior metal frame, the feeding portion F2 is disposed near a bottom portion of the electronic device, more specifically, a segmented portion between the side exterior metal frame 51 and the bottom center exterior metal frame 53.

The side exterior metal frame 51 operates with loop radiation through power feeding from the feeding portion F2, or the slit 54 may operate with radiation, when the switch S is in the position shown in FIG. 10A. The bottom center exterior metal frame 53 operates as a radiator through power feeding from the feeding portion F2 when the switch S is in the position shown in FIG. 9A. The switch S may include a diplexer, or may be replaced with the diplexer.

As shown in FIGS. 9A-10B, the slit 54 is provided as a uniform gap between the side exterior metal frame 51 and the PCB B. A resonant length can be adjusted by adjusting an electrical length of the slit 54. The side exterior metal frame 51 is grounded at ground shorting point G3 to the PCB B. The resonant length can be adjusted in accordance with a length of the slit 54 existing between the grounded shorting point G3 and the feeding portion F2. A resonance point may move to a high band when the ground portion G4 is located close to the feeding portion F2. That is, the resonance location can be adjusted by adjusting the slit length.

A connection of the ground portion G4 is described with reference to FIG. 9A to FIG. 9C and FIG. 10B.

Referring to FIG. 9A, the switch S connects the feeding portion F2 to the bottom exterior metal frame 53, the ground portion G4 is connected to the switch S located in a segmented portion between the side exterior metal frame 51 and the bottom exterior metal frame 53. In particular, the ground portion G4 is connected to the switch S located in the segmented portion between the side exterior metal frame 51 and the bottom exterior metal frame 53.

Referring to FIG. 9B, the switch S connects the feeding portion F2 to the bottom exterior metal frame 53, and the ground portion G4 is connected to the bottom exterior metal frame 53. In particular, the ground portion G4 is directly connected to the bottom exterior metal frame 53.

Referring to FIG. 9C, the switch S connects the feeding portion F2 to the bottom exterior metal frame 53 and a radiation path is formed with the ground portion G4 disconnected from any exterior metal frame.

Referring to FIG. 10B, the switch S connects the feeding portion F2 to the side exterior metal frame 51, and the ground portion G4 is connected to the bottom exterior metal frame 51. In particular, the ground portion G4 may be connected to the bottom exterior metal frame 51.

Figure 11:
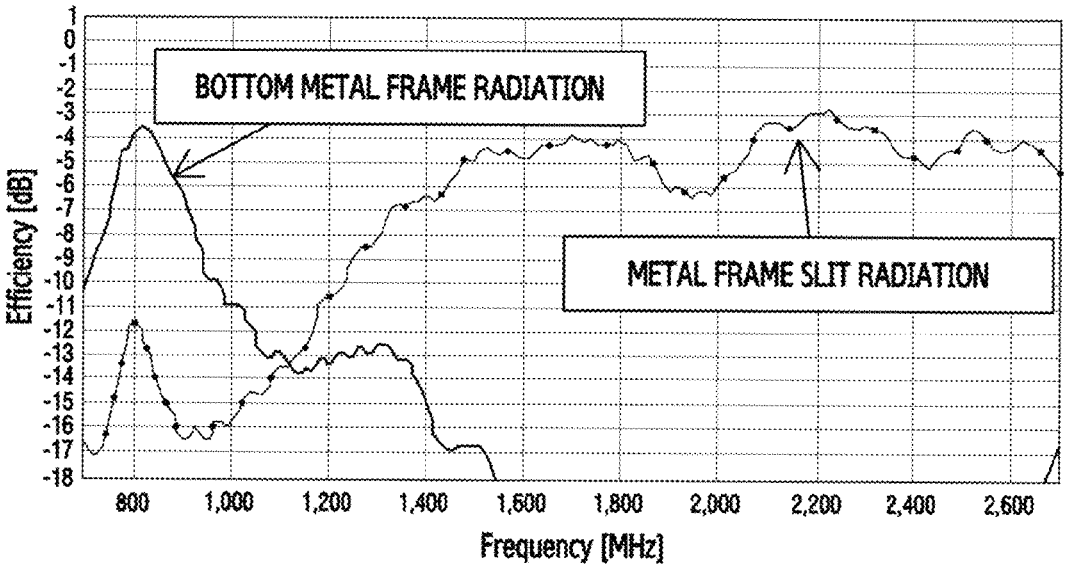
FIG. 11 is a graph illustrating efficiency of an antenna of the present invention operating in multiple bands by power feeding through a switch to an exterior metal frame, comparing bottom metal from radiation to metal frame slit radiation according to an embodiment of the present invention.

FIG. 11 is a graph illustrating an efficiency of an antenna of the present invention operating at multiple bands by power feeding through a switch to an exterior metal frame, comparing bottom metal radiation to metal frame slit radiation. Independent antenna resonance is used to select a low band and a high band according to switching of a feeding portion.

TABLE 2

| | EGSM | DCS | PCS | B1 | B40 | B41 |
|---|---|---|---|---|---|---|
| bottom metal frame | 36% | | | | | |
| metal frame slit | | 36% | 25% | 34% | 38% | 38% |

FIG. 11 shows passive efficiency of the antenna according to the present invention, with a multi-band operation antenna in which a low band and a high band operate independently, and are implemented through operation of the switch to the feeding portion. A resonance of a low band, e.g., for EGSM (880~960 $MH_Z$) service, is implemented by using the bottom center metal frame in the switch operation of the feeding portion. A resonance of a high band, e.g., for DCS (1710~1880 $MH_Z$) or PCS (1850~1990 $MH_Z$) or W1 (1920~2170 $MH_Z$) or B40 (2300~2400 $MH_Z$) or B41 (2496~2690 $MH_Z$) service, is implemented by using the side exterior metal frame in the switch operation of the feeding portion.

Figure 12:
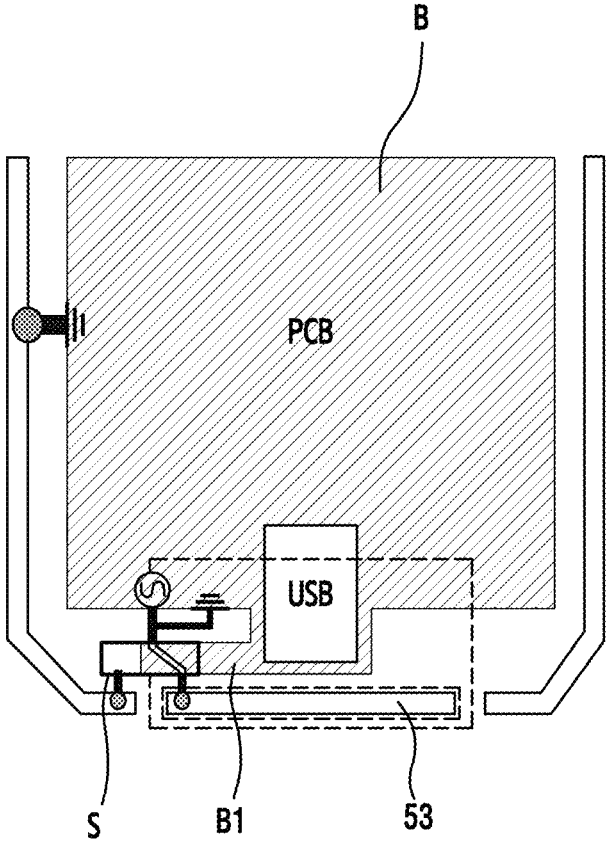
FIG. 12 illustrates an antenna structure using a switch and a secondary PCB according to an embodiment of the present invention.
Figure 13:
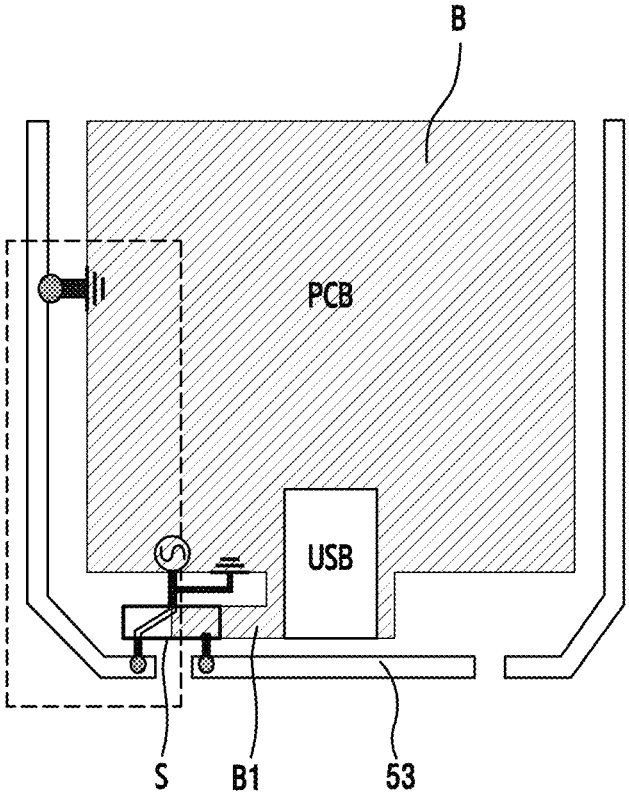
FIG. 13 illustrates an antenna structure using a switch and a secondary PCB according to an embodiment of the present invention.

FIGS. 12 and 13 illustrate an antenna structure using a switch and a secondary PCB according to an embodiment of the present invention.

Referring to FIG. 12 and FIG. 13, an antenna is provided utilizing that a switch S with a secondary PCB B1 extended from a PCB B.

The PCB B additionally includes the secondary PCB B1 on which the switch S is placed. The secondary PCB B1 extends up to the switch S, along the bottom exterior metal frame 53 while maintaining a specific gap with respect to the bottom exterior metal frame 53.

Figure 14:
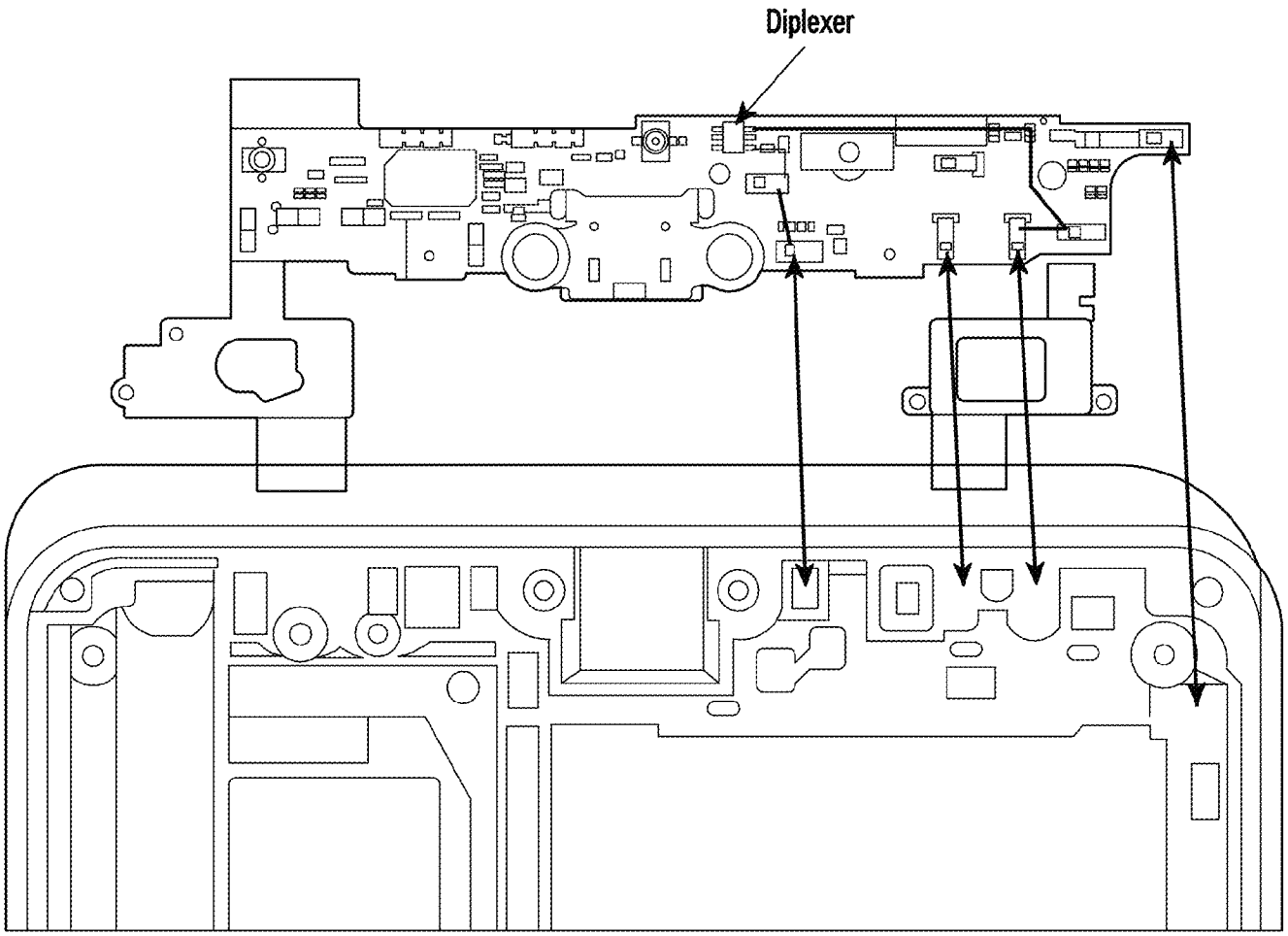
FIG. 14 illustrates placement of the diplexer in an antenna structure according to an embodiment of the present invention.
Figure 15:
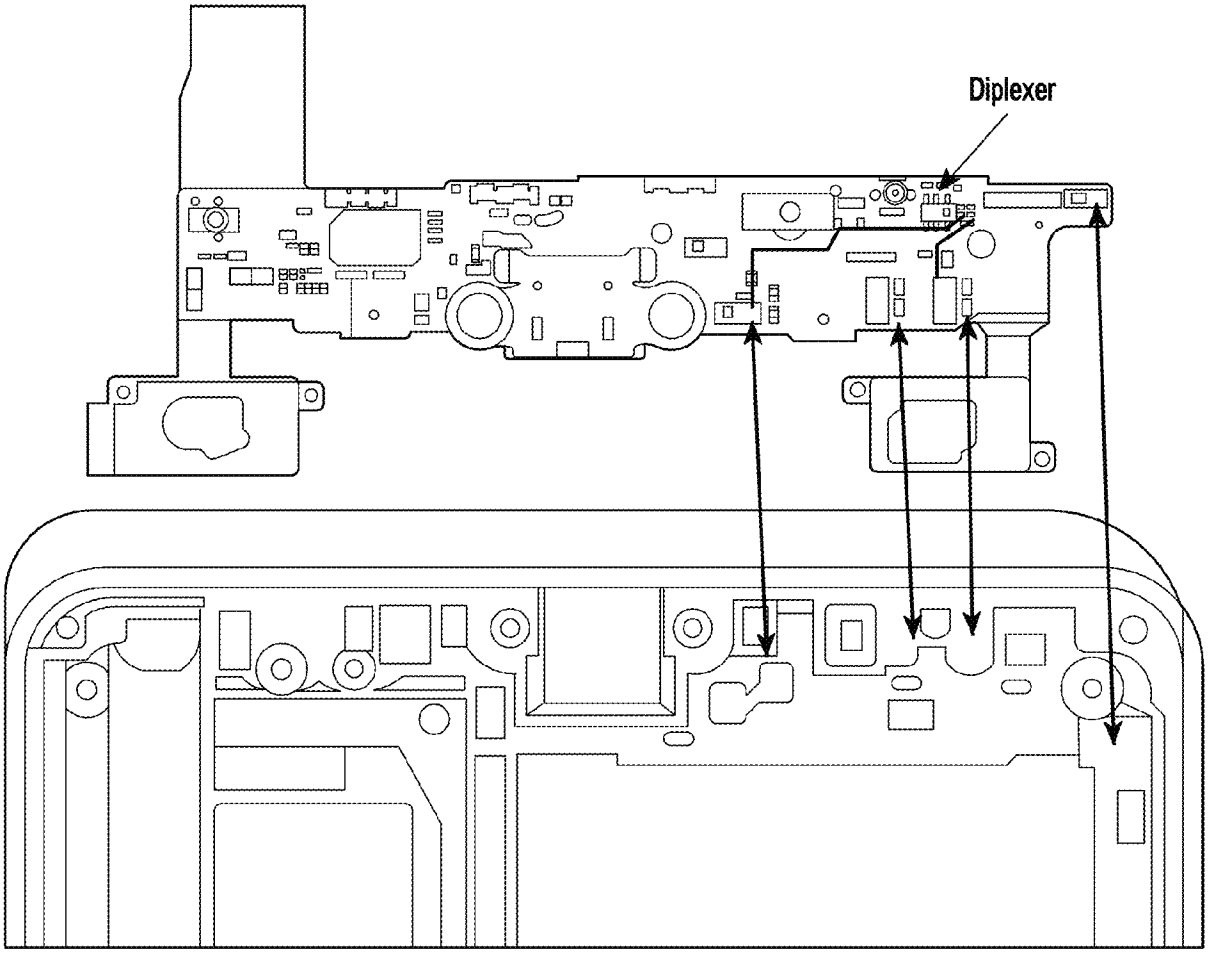
FIG. 15 illustrates another placement of the diplexer in an antenna structure according to various embodiments of the present invention.

FIG. 14 illustrates placement of the diplexer in an antenna structure frame according to an embodiment of the present invention. FIG. 15 illustrates another placement of the diplexer in an antenna structure frame according to an embodiment of the present invention.

In the embodiments of the present invention, a terminal using a metal frame construction utilizes the metal frame construction as a radiator to overcome an insufficient space of placing an antenna when the metal frame construction is used and antenna radiation performance deterioration caused by a metal material.

In addition, in the embodiments of the present invention, two types of radiation, i.e., radiation of a metal frame itself and radiation of a slit formed with a bracket having a support structure, are utilized to produce multiple resonances, thereby being able to ensure radiation performance.

In addition, in the embodiments of the present invention, a metal frame segment location and a power feeding location are disposed to a bottom portion by considering an influence of gripping, thereby being able to improve an influence on human body.

While the invention has been shown and described with reference to certain embodiments thereof, it will be understood by those skilled in the art that various changes in form and details may be made therein without departing from the spirit and scope of the invention as defined by the appended claims. Therefore, the scope of the present invention is defined not by the detailed description of the present disclosure but by the appended claims, and all differences within the scope will be construed as being included in the present invention.

What is claimed is:

1. An antenna of an electronic device, the antenna comprising:

a Printed Circuit Board (PCB);

a plurality of segment-type exterior metal frames spaced apart from the PCB;

a feeding portion connected to one metal frame of the plurality of segment-type exterior metal frames; and a slit located between the PCB and the one metal frame, wherein the one metal frame operates with radiation through the feeding portion, or the slit operates with radiation, or another exterior metal frame operates with radiation through the feeding portion, wherein the plurality of segment-type exterior metal frames comprise one side exterior metal frame and a bottom exterior metal frame, and wherein the one side exterior metal frame is grounded to the PCB, and a resonant length is adjusted to a slit length between the feeding portions and a ground shorting point.

2. The antenna of claim 1 wherein the plurality of segment-type exterior metal frames have a structure in which the frames are segmented apart from each other.

3. The antenna of claim 2, wherein the feeding portion is located near a portion between the side exterior metal frame and the bottom exterior metal frame.

4. The antenna of claim 2, wherein the bottom exterior metal frame comprises:

a bottom center exterior metal frame;

a bottom first-side exterior metal frame disposed on one side of the bottom center exterior metal frame; and a bottom second-side exterior metal frame disposed on the other side of the bottom center exterior metal frame.

5. The antenna of claim 4, wherein the bottom center exterior metal frame is configured to directly connect to the bottom first-side exterior metal frame.

6. The antenna of claim 5, wherein the bottom first-side exterior metal frame further comprises an additional radiator to adjust a resonant length.

7. The antenna of claim 6, wherein the additional radiator is disposed on a carrier separated from the PCB.

8. The antenna of claim 7, wherein the one side exterior metal frame operates as a loop antenna, and each of the bottom first-side exterior metal frame and the additional radiator operates as a Planar Inverted F Antenna (PIFA).

9. The antenna of claim 1, wherein a resonance location moves to a high band when the ground shorting point is close to the feeding portion.

10. The antenna of claim 2, wherein the slit is disposed between and is radiated by the one side exterior metal frame and an internal bracket.

11. The antenna of claim 10, wherein the internal bracket comprises a metal material, and is constructed as a display bracket.

12. An antenna comprising:

a Printed Circuit Board (PCB);

a plurality of exterior metal frames separated from the PCB and having a structure in which each of the plurality of exterior metal frames are segmented from each other;

a feeding portion connected to one metal frame of the plurality of exterior metal frames;

a slit located between the PCB and one side exterior metal frame; and a switch for selectively operating one metal frame of the plurality of exterior metal frames, wherein the one metal frame through the switch operates with radiation, or the slit operates with radiation, or another metal frame through the switch operates with radiation, wherein the plurality of exterior metal frames comprise the one side exterior metal frame and a bottom exterior metal frame, and wherein the one side exterior metal frame is grounded to the PCB, and a resonant length is adjusted to a slit length between the feeding portion and a ground shorting point.

13. The antenna of claim 12, wherein the plurality of exterior metal frames have a structure in which the plurality of exterior metal frames are segmented from each other.

14. The antenna of claim 13, wherein the feeding portion is located near a segmented area between the one side exterior metal frame and the bottom exterior metal frame.

15. The antenna of claim 13, wherein the one side exterior metal frame operates as a high-band loop radiator, and the bottom exterior metal frame operates as a low-band loop radiator.

16. The antenna of claim 12, wherein a resonance location moves to a high band when the ground shorting point is close to the feeding portion.

17. The antenna of claim 12, wherein the switch comprises a diplexer.

18. An electronic device comprising:

a main body;

a plurality of segment-type exterior metal frames covering at least two side surfaces of the main body;

a Printed Circuit Board (PCB) separated from the plurality of segment-type exterior metal frames, with the PCB provided in the main body;

a feeding portion connected to one metal frame of the plurality of segment-type exterior metal frames; and a slit located between the PCB and the one metal frame, wherein the one metal frame fed through the feeding portion operates with radiation, or the slit operates with radiation, or another exterior metal frame fed through the feeding portion operates with radiation, wherein the plurality of segment-type exterior metal frames comprise one side exterior metal frame and a bottom exterior metal frame, and wherein the one side exterior metal frame is grounded to the PCB, and a resonant length is adjusted to a slit length between the feeding portions and a ground shorting point.

* * * * *